United States Patent [19]

Barton et al.

[11] 4,214,696

[45] Jul. 29, 1980

[54] CONTAINER WITH INTEGRAL PARTITION

[75] Inventors: Paul R. Barton, Nashville; Johnnie M. Welborn, Clarksville, both of Tenn.

[73] Assignee: Container Corporation of America, Chicago, Ill.

[21] Appl. No.: 52,413

[22] Filed: Jun. 27, 1979

[51] Int. Cl.[3] ..... B65D 5/48; B65D 5/50; B65D 81/00

[52] U.S. Cl. ..... 229/40; 229/33; 206/459; 206/605

[58] Field of Search ..... 229/40, 41 C, 33, 39, 229/44; 206/459, 605

[56] References Cited

U.S. PATENT DOCUMENTS

| | | | |
|---|---|---|---|
| 2,024,832 | 12/1935 | Myers | 229/33 X |
| 2,284,815 | 6/1942 | Grimm | 229/39 R X |
| 2,565,188 | 8/1951 | Welshenbach | 229/41 C X |
| 2,832,466 | 4/1958 | Sheard | 229/41 C X |
| 2,852,133 | 9/1958 | Bonini et al. | 206/459 X |
| 3,371,845 | 3/1968 | Freiman | 229/39 R |
| 3,495,757 | 2/1970 | Pascus et al. | 206/605 X |
| 3,758,019 | 9/1973 | Struble | 229/40 X |
| 3,809,310 | 5/1974 | Vanderlugt, Jr. | 229/41 C X |
| 4,105,155 | 8/1978 | Forbes | 229/33 |

*Primary Examiner*—Davis T. Moorhead
*Attorney, Agent, or Firm*—Carpenter & Ostis

[57] ABSTRACT

A container is formed from paperboard, or the like, and has an integral, internal partition which separates the products located in the container.

1 Claim, 5 Drawing Figures

CONTAINER WITH INTEGRAL PARTITION

BACKGROUND OF THE INVENTION

1. Field of the Invention

This invention relates to a container formed from paperboard, or the like, and, more particularly, to a container having an integral, internal partition.

2. The Prior Art

U.S. Pat. Nos. 2,852,133 to Bonini et al and 3,495,757 to Pascus et al disclose rectangular bottom panels with triangular closure panels connected to the sides of a container and folded in spaced relationship to the bottom panel and in an overlapping relationship thereto. U.S. Pat. Nos. 2,284,815 to Grimm and 3,371,845 to Freiman show tabs folded down from a top closure panel but these tabs do not form partitions bearing against the bottom panel, nor do they improve the stacking strength of the container.

SUMMARY OF THE INVENTION

The container of the present invention includes tabs foldably attached to certain closure panels. These tabs are folded downwardly into the container to contact a main, or bottom, panel thereof thereby partitioning the container into compartments. The tabs, in the folded down position, improve the stacking strength of the container by acting as additional supports resisting compressive forces.

DRAWINGS

Figure 1:
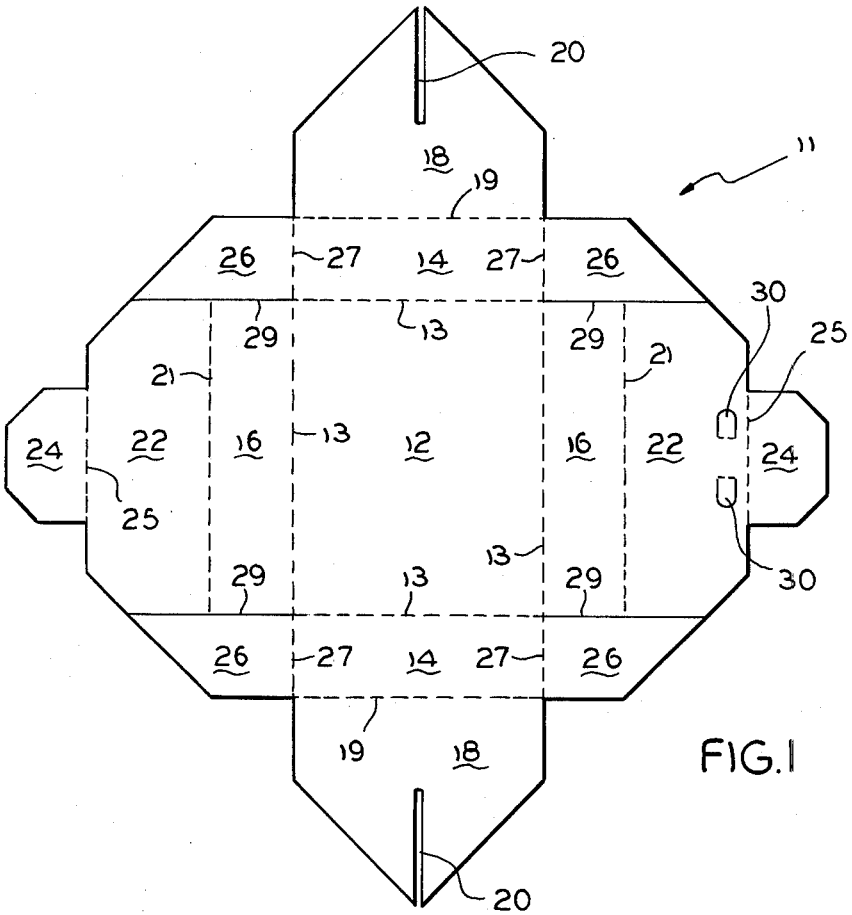
FIG. 1 is a plan view of a blank for forming a container of the present invention.
Figure 2:
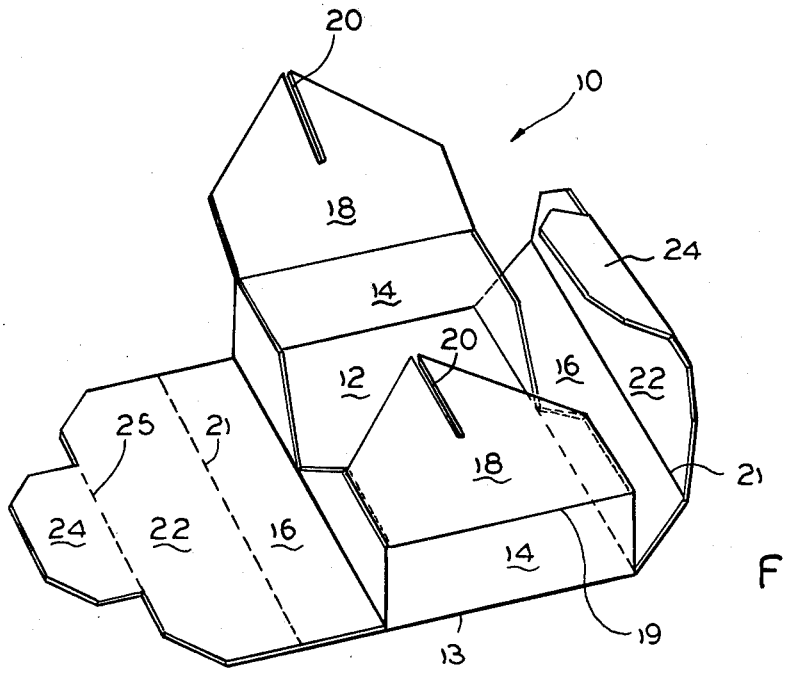
FIG. 2 is a perspective view of a partially erected container.
Figure 3:
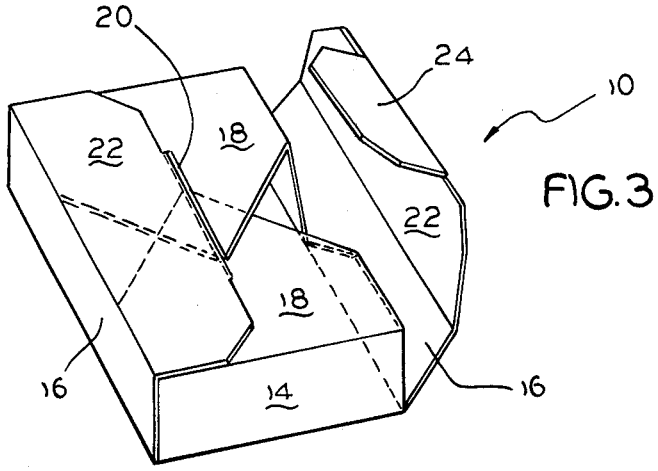
FIG. 3 is a perspective view of the container in partially closed condition.
Figure 4:
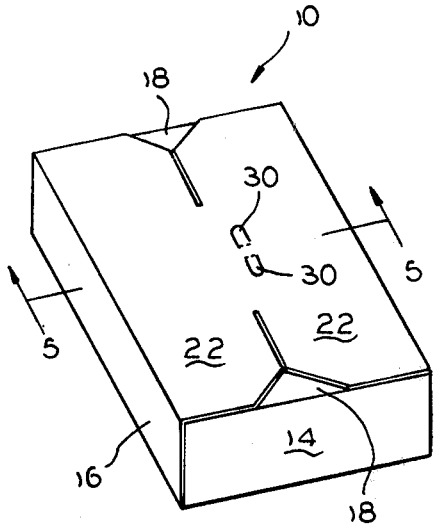
FIG. 4 is a perspective view of the container in a closed condition.
Figure 5:
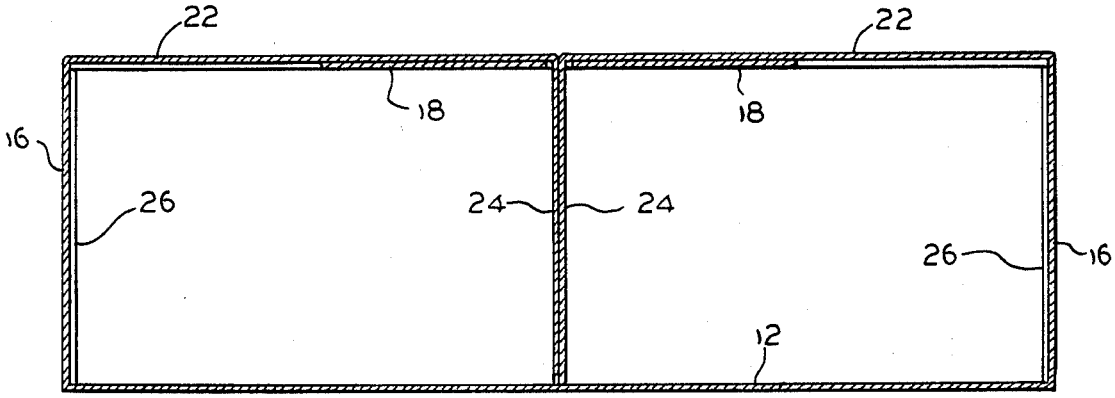
FIG. 5 is a sectional view taken generally along the line 5—5 of FIG. 4.

Referring now to the drawings, a container, generally designated 10, is formed from a blank 11 of paperboard, or the like. The container is formed with integral, internal partitions which provide product separation within the container and improve the stacking and compression strength of the container.

A main panel 12 has two pairs of side panels foldably joined thereto along fold lines 13. A first pair of side panels 14 are attached to the main panel along two opposite edges thereof while a second pair of side panels 16 are similarly attached to the main panel 12 along the two remaining opposite edges.

Both of the side panels 14 have closure flaps 18 foldably joined thereto along fold lines 19. Each of the closure flaps 18 has an elongated slot 20 formed therein for the purpose which will become apparent from further description of the structure of this invention.

When the container is closed, the closure flaps 18 are folded in first so as to become inner closure flaps of the container 10.

Attached to the side panels 16 along fold lines 21, there are outer container closure flaps 22 which overlie the flaps 18 when the container is closed.

The outer closure flaps 22 have tabs 24 foldably attached thereto along fold lines 25. The tabs 24 are folded normal to the main panel 12 when the container is closed and are received in the slots 20 of the inner closure flaps 18. The height of the tabs 24 is such that they bear against the main panel 12 providing an internal partition of the container formed from multiple plies of paperboard.

The tabs 24 contact the main panel and improve the stacking strength of the container by providing added resistance to compression forces acting against such containers in a stack.

To improve the general strength of the container, the same is formed with a plurality of internal side wall flaps 26 foldably attached along fold lines 27 to the edges of the side panels 14 but free from attachment to the edges of the side panels 16 as indicated by cut lines 29. The internal side wall flaps 26 are folded inwardly and against the side panels 16.

In the exemplary embodiment illustrated herein, one of the outer closure flaps 22 is formed with a pair of finger receiving openings 30 to assist a user in opening the container.

When the container is formed from a blank of corrugated paperboard, the blank 11 may be so arranged as to have the corrugations disposed diagonally across the blank thereby strengthening the container.

We claim:

1. A container formed from a blank of paperboard, or the like, and having an integral, internal product separating partition, comprising:

(a) a main panel;

(b) pairs of first and second side panels foldably joined to the respective edges of said main panel and upstanding therefrom;

(c) closure flaps foldably attached to said side panels and including:

(i) inner closure flaps attached to the edges of each of said side panels of one of said pairs and having elongated slots formed therein;

(ii) outer closure flaps attached to the edges of each of said side panels of the other of said pairs and having tabs formed along the outer edges thereof;

(iii) said inner and outer closure flaps being folded in an overlapping relationship spaced from and substantially parallel to said main panel so as to close said container;

(iv) said tabs being folded normal to said main panel and being received in said slots;

(v) said tabs extending into said container and bearing against said main panel thereby forming an internal partition within said container.

* * * * *